United States Patent [19]

Strohschneider

[11] 4,270,453

[45] Jun. 2, 1981

[54] BIDIRECTIONAL IMPRINTER

[75] Inventor: Heinz F. Strohschneider, Plymouth, Mass.

[73] Assignee: Dymo Industries Inc., Garden City, N.Y.

[21] Appl. No.: 770,628

[22] Filed: Feb. 22, 1977

[51] Int. Cl.[3] ..... B41F 3/04

[52] U.S. Cl. ..... 101/269

[58] Field of Search ..... 101/269, 56

[56] References Cited

U.S. PATENT DOCUMENTS

| | | | |
|---|---|---|---|
| 3,272,120 | 9/1966 | Johnson | 101/56 |
| 3,577,917 | 5/1971 | Nantz | 101/269 |
| 3,602,139 | 8/1971 | Allport | 101/269 |
| 3,704,668 | 12/1972 | St. Onge et al. | 101/269 |
| 3,763,777 | 10/1973 | Brown | 101/269 |
| 3,838,641 | 10/1974 | McInnis | 101/269 |

FOREIGN PATENT DOCUMENTS

| | | | |
|---|---|---|---|
| 2447714 | 10/1974 | Fed. Rep. of Germany | 101/269 |

*Primary Examiner*—Paul T. Sewell

*Attorney, Agent, or Firm*—Gerald J. Ferguson, Jr.; Joseph J. Baker

[57] ABSTRACT

A bidirectional imprinter having a print roll carriage with sidewalls and two pairs of inclined slots disposed in the sidewalls where the first pair is oppositely inclined with respect to the second pair. First and second print rolls are respectively associated with the first and second pairs of slots so that movement of the carriage over the print bed causes the first print roll to move down its associated slot pair to effect imprinting while the second print roll is moved up its associated slot pair in a non-imprinting relation with respect to the print bed. The functions of the print rolls are interchanged during the reverse stroke. The imprinter may comprise a unitary, extruded base with an elongated receptacle extending along the upper length thereof and a molded plastic print bed inserted within the receptacle. An elongated recess in the print bed may also be provided so that a portion of a credit card or the like overlying the recess can be depressed therein to raise the remainder of the card and permit easy removal thereof.

7 Claims, 20 Drawing Figures

BIDIRECTIONAL IMPRINTER

CROSS REFERENCE TO RELATED APPLICATION

This application is related to a patent application filed Feb. 8, 1977 by James H. Bowen and entitled "Improved Imprinter and Method of Making Same" and assigned Ser. No. 766,573.

BACKGROUND OF THE INVENTION

1. Field of the Invention

This invention relates to imprinting devices and in particular to bidirectional imprinters suitable for imprinting different fields of data depending upon the direction in which the imprinter is operated.

2. Discussion of the Prior Art

Various bidirectional imprinters are known and have been disclosed in U.S. Pat. Nos. 3,272,120, 3,340,800, 3,577,917, 3,750,569, 3,763,777, 3,810,424 and 3,862,598. In a bidirectional imprinter there is usually critical data which is imprinted onto a document such as an invoice from a portable printing plate such as a credit card. There is also non-critical data imprinted on the invoice from a fixed printing plate such as a dealer's plate. It is important that the critical data be very leglible since it is usually intended for reading by an automatic character recognition device or the like. Since these devices are capable of erroneous character recognition if the data is not imprinted exactly correct, it is desirable to employ a bidirectional imprinter where the critical data is imprinted when the imprinting roller carriage passes over the print bed in a first direction and the non-critical data is imprinted during a pass in the opposite direction. Thus, there is no adverse effect on the quality of the imprinted critical data due to imprinting non-critical data at the same time. The prior art bidirectional imprinters as exemplified by the above patents, have implemented the bidirectional imprinting function with various mechanical arrangements which have not only been complicated but expensive and difficult to maintain.

In U.S. Pat. No. 3,838,641 (which is hereby incorporated herein by reference) there is disclosed an imprinter wherein imprinting pressure is effected by mounting the ends of the print roller shafts into grooves angled with respect to the print bed whereby relative movement of the print roller carriage and the print bed in the imprinting direction forces the shafts to the bottom of the slots whereby imprinting can be effected. The imprinter is not bidirectional.

SUMMARY OF THE INVENTION

It is a primary object of this invention to provide a mechanically simple, inexpensive, easily maintained bidirectional imprinter.

It is a further object of this invention to provide an inexpensive imprinter, the base of which is an integral, extruded unit and the print bed of which is a plastic sheet insertable into the extruded base.

It is a further object of this invention to provide an imprinter wherein a portable printing plate such as a plastic credit card can be readily removed.

It is a further object of this invention to provide an improved method of making an imprinter of the above type.

Other objects and advantages of this invention will become apparent after a reading of the specification and claims taken with the drawing.

DETAILED DESCRIPTION OF AN ILLUSTRATIVE EMBODIMENT OF THE INVENTION

Figure 1:
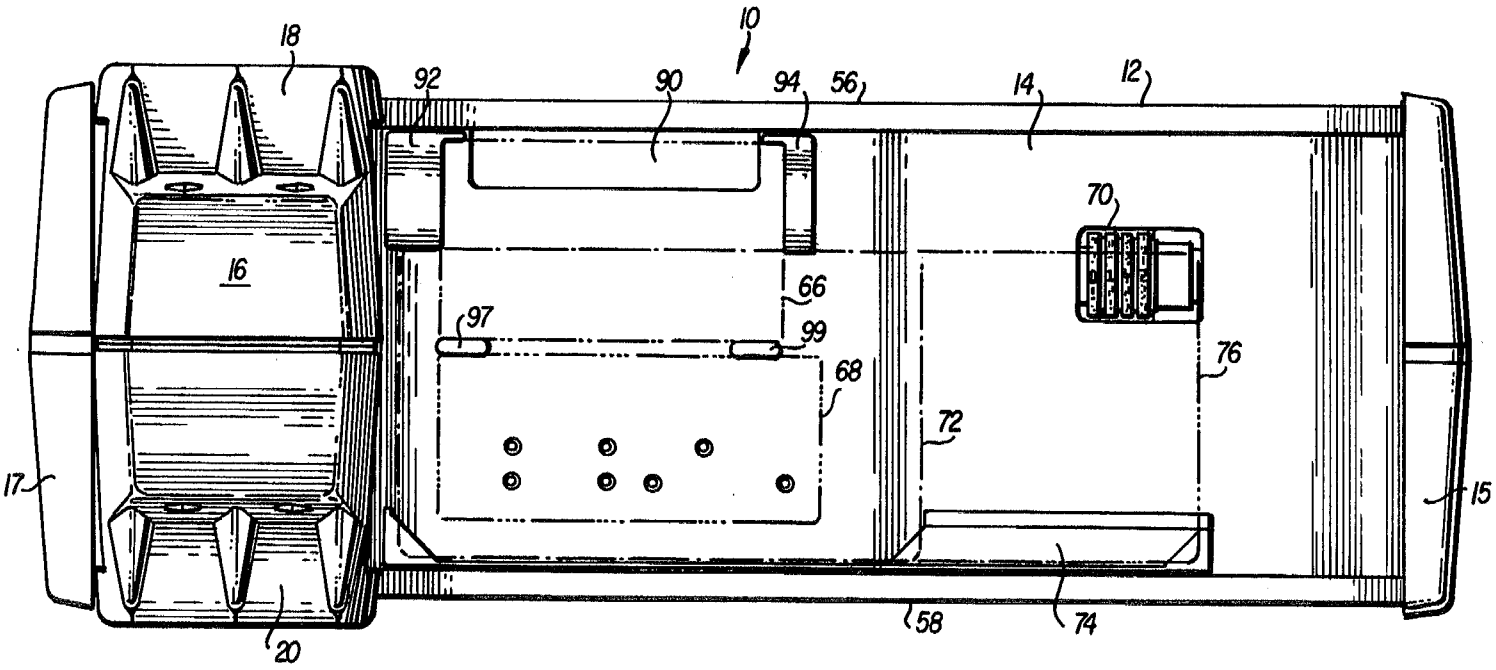
FIGS. 1-3 are plan, elevation and end views respectively of an illustrative imprinter in accordance with the invention.

Reference should be made to the drawing where like reference numerals refer to like parts. In particular, reference should be made to FIGS. 1-8 and the description corresponding thereto, the foregoing being primarily directed to the claimed subject matter whereas FIGS. 9-19 and the description corresponding thereto are primarily directed to the subject matter claimed in the aforementioned co-pending patent application.

Figure 2:
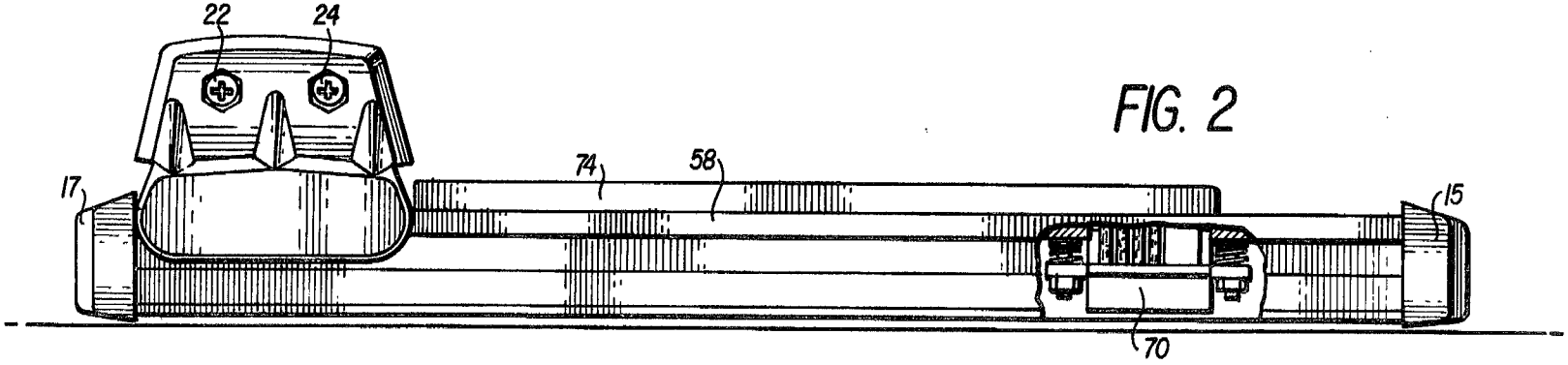
Figure 3:
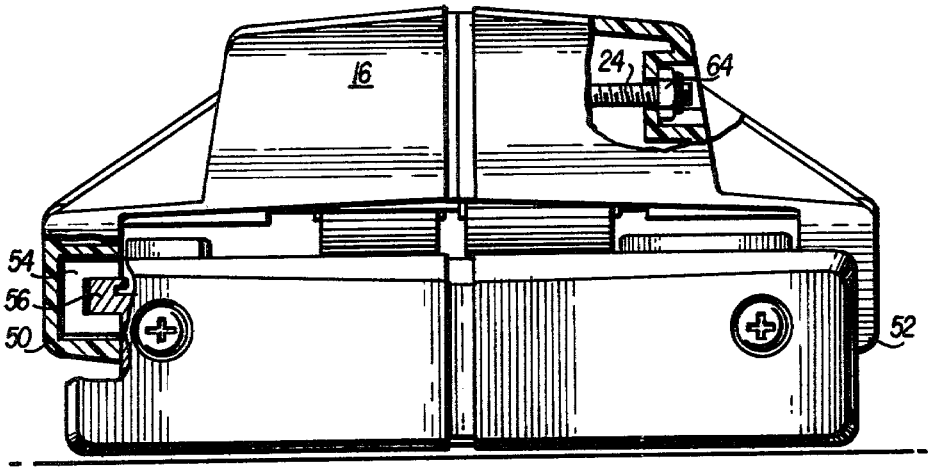
Figure 4:
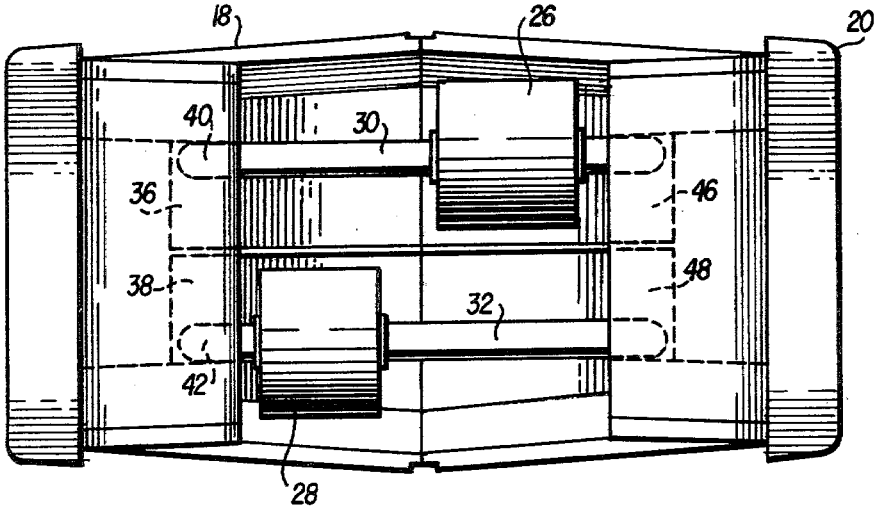
FIG. 4 is a bottom view of the carriage assembly of FIGS. 1-3.

Referring to FIGS. 1-7, there is shown an imprinter 10 comprising a base 12, which is extruded as an integral piece as will be described in more detail hereinafter with respect to FIGS. 9-11. Inserted in base 12 is a print bed 14 molded from plastic or the like which will be described in more detail hereinafter with respect to FIGS. 12-19. End caps 15 and 17 are disposed at opposite ends of the base. A print roll carriage generally indicated at 16 comprises sections 18 and 20 which are held together by bolts 22 and 24. Carriage 16 contains print rollers 26 and 28 which are respectively mounted on shafts 30 and 32 as shown in FIG. 4.

Figure 5:
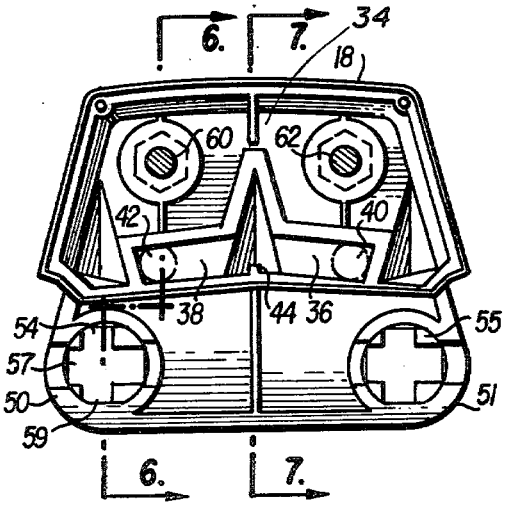
FIG. 5 is an interior, side elevation view of a portion of the carriage housing of FIGS. 1-3.

The ends of shafts 30 and 32 are respectively slideably disposed in slots disposed in the sidewalls of carriage 16. Referring to FIG. 5, there is shown section 18 of carriage 16. Disposed within the sidewall 34 of section 18 are oppositely angled slots 36 and 38. Diagrammatically indicated in FIG. 5 are the ends 40 and 42 of shafts 30 and 32 as can also be seen in FIG. 4. Slot 36 is separated from slot 38 by a rib 44. Section 20 of carriage 16 is also provided with a pair of oppositely angled slots, these slots being indicated at 46 and 48 in FIG. 4. Hence, slots 36 and 46 form a first pair of slots for slidingly receiving the respective ends of shaft 30 where these slots have the same angular inclination with respect to print bed 14. Slots 38 and 48 comprise a second slot pair for slidingly receiving the ends of shaft 32 where this second slot pair is angularly inclined with respect to the print bed in an orientation opposite to that of the first slot pair.

As can be seen in FIGS. 3 and 5, each carriage section is provided with a pair of U-shaped recesses where recesses 50 and 51 are shown in FIG. 5 and recesses 50 and 52 are shown in FIG. 3. Fixedly disposed within the U-shaped recesses are U-shaped slides where slides 54 and 55 are disposed within recesses 50 and 51 as shown in FIGS. 3 and 5. Slides 54 and 55 slidingly engage a rail 36 of base 12 while corresponding slides (not shown) slidingly engage a rail 58 whereby carriage 16 can be moved over the print bed 14 in either direction. As can also be seen in FIG. 5, slide 54 has off center, mutually perpendicular slots 57 and 59 extending therethrough whereby, depending on the position of slide 54 within recess 50, the clearance between the print rollers and the print bed may be adjusted to one of four different positions. Of course, the position of the other slides within their respective recesses would also have to be adjusted.

Figure 6:
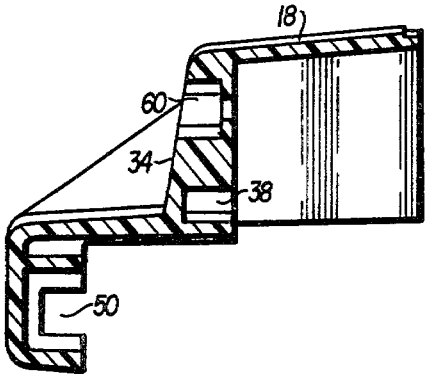
FIGS. 6 and 7 are cross-sectional views taken along the lines 6—6 and 7—7 of FIG. 5.
Figure 7:
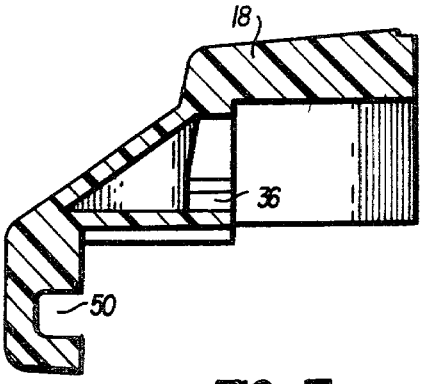

Also shown in FIGS. 5 and 6 are holes 60 and 62 through which bolts 22 and 24 respectively pass to secure together sections 18 and 20 of carriage 16. Nuts at the ends of the bolts are employed to tighten the sections together where nut 64 is shown in FIG. 3.

Removably disposed on print bed 14 is a portable printing plate such as a credit card indicated in phantom lines at 66 as shown in FIG. 1. A printing plate such as a dealer's plate is fixedly disposed on the print bed as indicated in phantom lines at 68. Further a variable data source 70 is also fixedly disposed with respect to the print bed where the variable data may comprise, for example, the date or amount of a transaction entered from print wheels. A first document indicated in phantom lines at 72 may be disposed as shown in FIG. 1 whereby data can be imprinted from plates 66 and 68 onto the invoice. As will be described in more detail hereinafter, the invoice holder generally indicated at 74 is capable of receiving either a document the size of invoice 72 or a longer document 76 the length of which extends over variable data source 70 whereby the transaction date or the like can be imprinted onto document 76 in addition to the data from plates 66 and 68.

The data from plate 66 and variable data wheels 70 is critical and intended for automatic machine reading and must be clearly imprinted whereas the data from print plate 68 is not critical since it is not intended for machine reading. Hence, in order to ensure clarity of the critical data, it is desirable to imprint the data from plate 66 and wheels 70 at a time difference from that when the data from plate 68 is imprinted.

Figure 8:
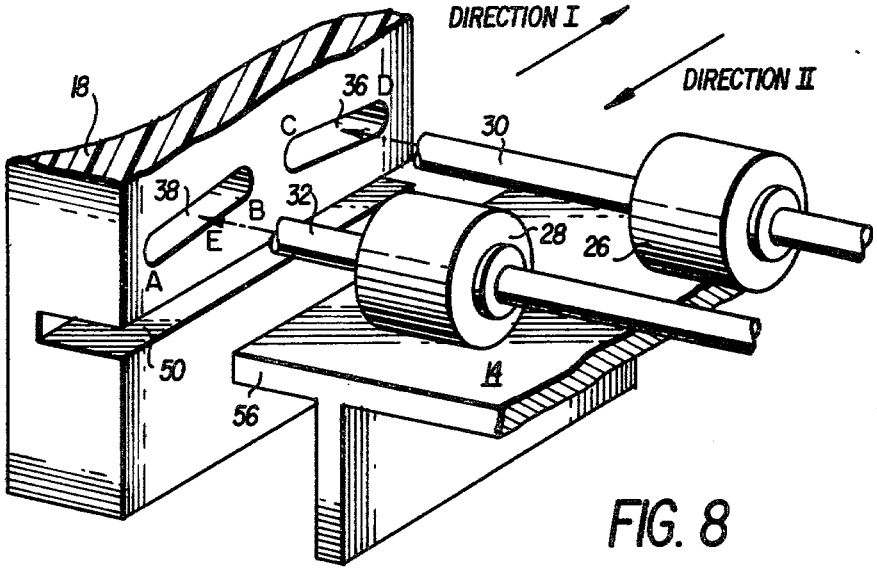
FIG. 8 is a partial diagrammatic representation of the imprinter of FIGS. 1-3.

In operation, the bidirectional imprinting feature of this invention is illustrated in FIG. 8 where certain parts of the invention described hereinbefore are diagrammically illustrated. When the rollers 26 and 28 are moved over print bed 14 in Direction I, roller 26 will eventually engage plate 68 of FIG. 1 and the invoice disposed thereover. This will force shaft 30 backwardly up inclined slots 36 and 46 whereby roller 26 will roll over plate 68 without imprinting dealer identification data, for example, onto the invoice. However, when roller 28 engages portable plate 66 and the invoice portion disposed thereover, the roller will again be forced backwardly. But since slots 38 and 48 are effectively downwardly inclined when the rollers are moved in Direction I, shaft 32 will slide down slots 38 and 48 so that roller 28 exerts imprinting pressure on portable plate 66 to thereby imprint the credit card data, for example, onto the invoice. A preferred value of the angular orientation of slots 36, 38, 46 and 48 with respect to the print bed is 6.3°, it being understood this value is not in the nature of limitation but rather of illustration.

Of course, data is also imprinted onto the invoice from variable data wheels 70 by roller 28 as it continues in Direction I. During the return stroke, the rollers are moved in Direction II and the rollers 26,28 interchange functions whereby the non-critical data is imprinted by roller 26 while roller 28 simply rolls over the critical data fields without exerting imprinting pressure. In particular, shaft 30 is forced down slots 36,46 during the return stroke while shaft 32 is forced up slots 38,48. As can be appreciated, the foregoing arrangements employ first slot pair 36,46 and second slot pair 38,48 where the first pair is oppositely inclined with the second pair in a bidirectional imprinter whereby critical and non-critical data fields can be successively imprinted to thereby obtain an economical, bidirectional imprinter as contrasted to the complicated, expensive structures employed to implement the bidirectional imprinting function in the prior art.

Another feature of this invention is illustrated in FIG. 8. Thus, assume shaft 32 is resting in the "B" position because of a tight fit or friction, etc. As the head or carriage is moved in direction I, roller 26 would approach the dealer plate and be moved from position "D" up the ramp towards "C" as it strikes the embossment or indicia on its associated printing member. Roller 28 and shaft 32 could still be in position "B" or "E" and as it approaches the embossment on the printing member or credit card it conceivably would not be driven down to position "A" until it was on top of or beyond the first embossed character and therefore could possibly result in a light print. The condition would apparently tend to be more acute as the velocity was increased. Thus, by making the diameter of rollers 26 and 28 of sufficient size, one roller will urge the other down to the optimum print position before the latter roller reaches the media that it is to imprint. In particular, assuming the head is moved in direction I, roller 26 would be of sufficient size that, as it moved up ramp 36 to "C", it would contact shaft 32 thereby positively driving roller 28 down to position "A" prior to the latter roller reaching the media to be imprinted. Of course, to accommodate movement of the head in direction II, roller 28 could also be appropriately sized to effect positive drive of roller 26 to its imprinting position "D" prior to its reaching the media to be imprinted.

Figure 11:
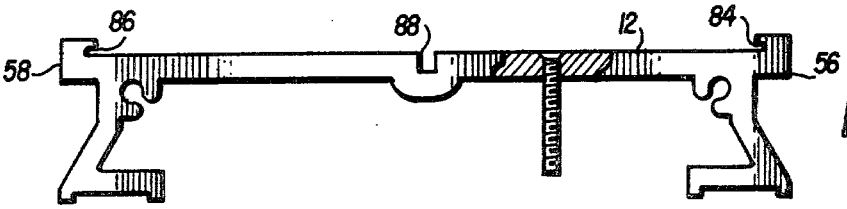
FIGS. 9-11 are plan, elevation and end views of a unitary extruded base in accordance with the invention.
Figure 9:
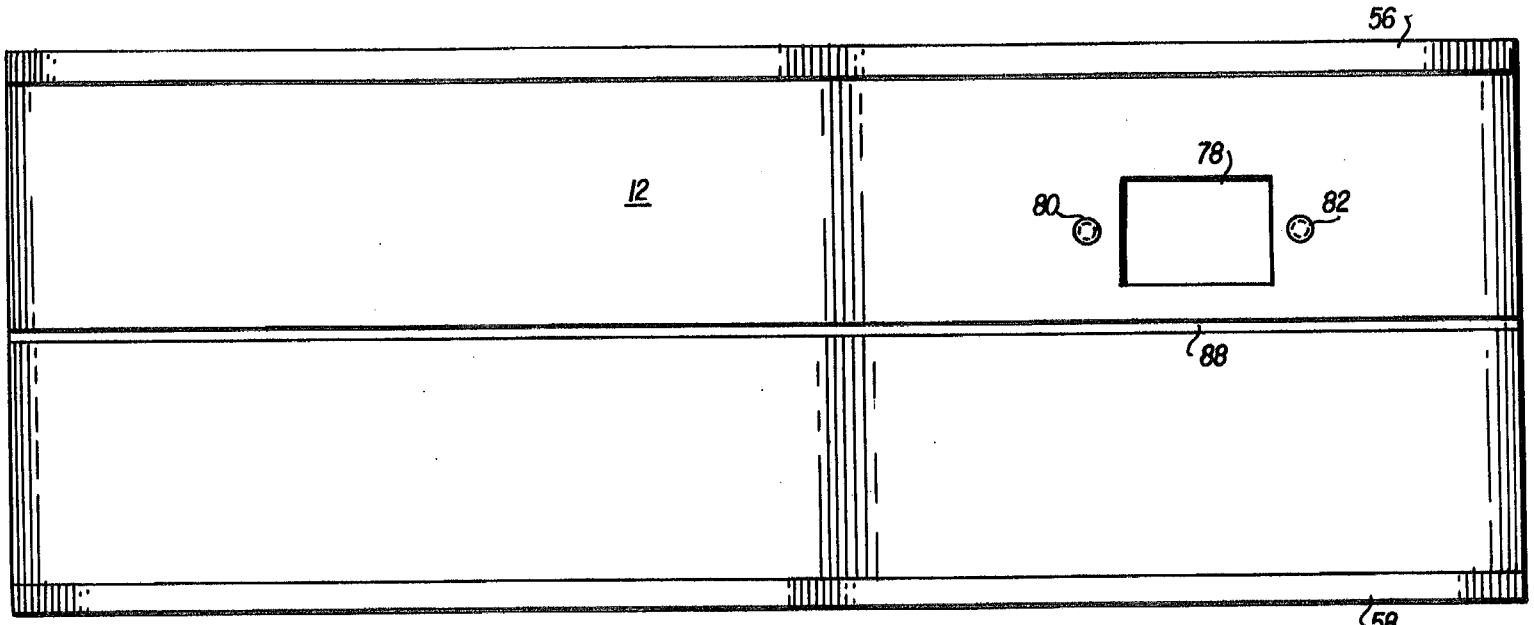
Figure 10:
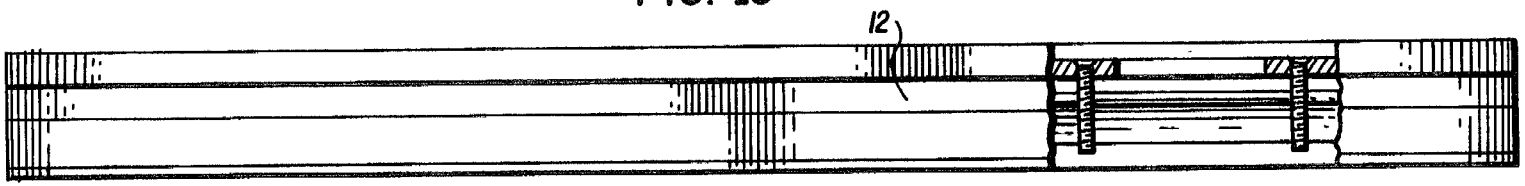

Another important feature of this invention which further substantially contributes to the simplicity thereof is illustrated with respect to FIGS. 9–19. Generally, this further feature of the invention is implemented by extruding base 12 into a single piece as indicated in FIGS. 9–11. An opening 78 and threaded bolt holes 80 and 82 may be machined through the base as indicated in FIG. 9 to accommodate variable data wheel 70. An elongated slot, the edges of which are indicated at 84 and 86 in FIG. 11 and which extends the upper length of base 12 provides a receptacle into which can be inserted print bed 14 which is shown in further detail in FIGS. 12–17. If holes 78–82 are not machined into base 12, there is no need for any machining whatsoever in constructing the imprinter of this invention. Hence, it can be seen that by extruding base 12 from a metal such as aluminum or any other appropriate material, and molding print bed 14 from a plastic material or the like, the imprinter of this invention is economically manufactured.

As can be further seen in FIGS. 9 and 10, base 12 has a center slot 88 extending through the center portion thereof, the purpose of which is to accommodate a card holder as will be described in more detail hereinafter. Also shown in FIGS. 2 and 10 are means for mounting the variable data wheels 70, the mounting means as such not forming a part of the invention.

Referring to FIGS. 12–17, the molded plastic printing bed 14 is shown in further detail. A particularly important feature of the molded plate is the recess 90 in the card holding portion of bed 14. As can be seen in FIG. 1, card 66 overlies recess 90. Hence by simply pressing down on the portion of card 66 overlying recess 90, the remaining portion of the card will rise slightly thereby permitting ready removal of the card from the print bed.

Figure 12:
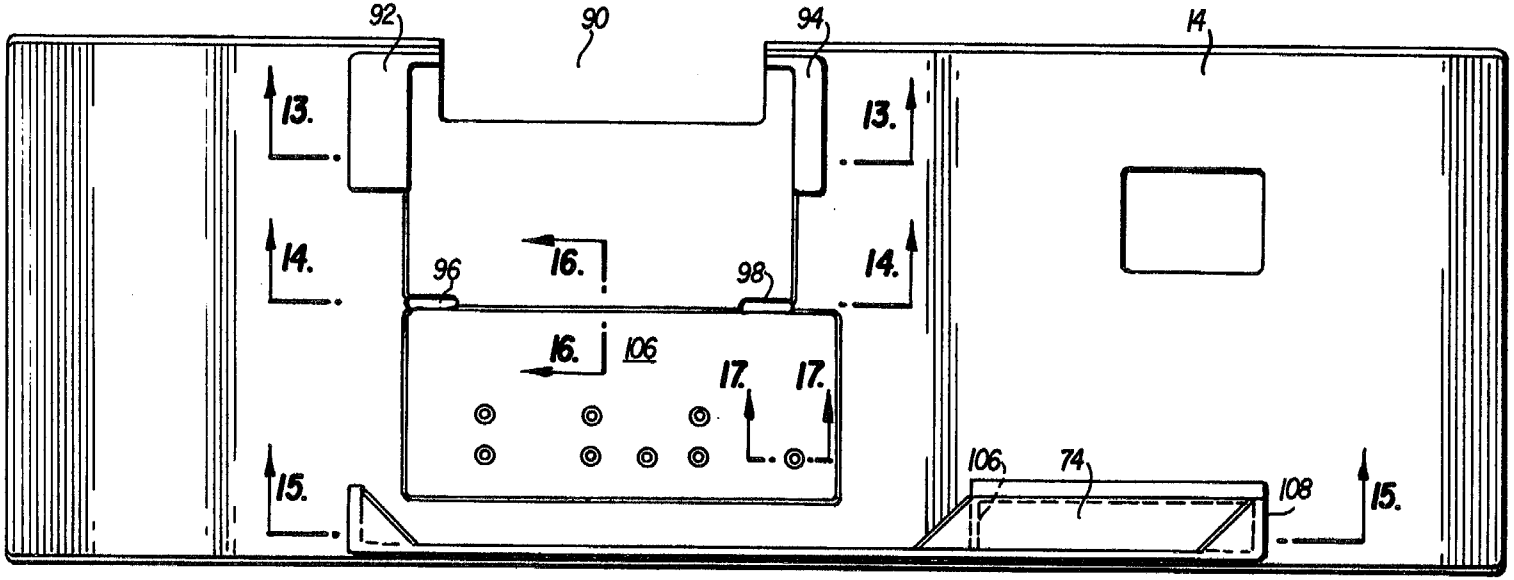
FIG. 12 is a plan view of an insertable, molded plastic print bed in accordance with the invention.
Figure 13:
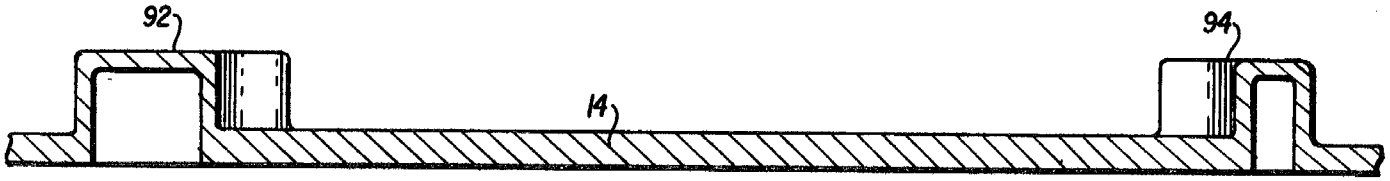
FIGS. 13-17 are cross-sectional views taken respectively along the lines 13—13, 14—14, 15—15, 16—16, and 17—17 of FIG. 12.
Figure 14:
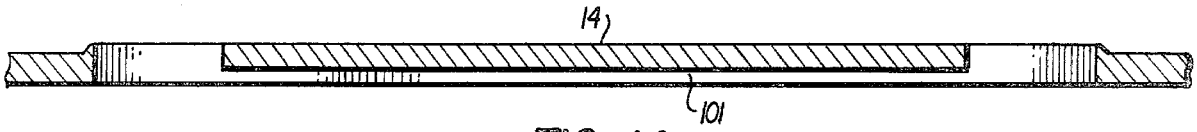
Figure 18:
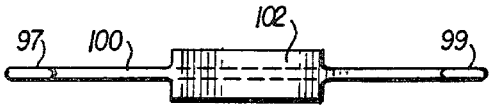
FIGS. 18 and 19 are plan and side elevation views of a card holder in accordance with the invention.
Figure 19:
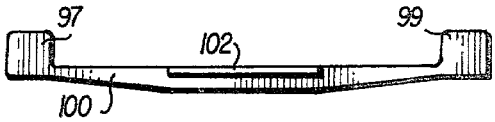
Figure 20:
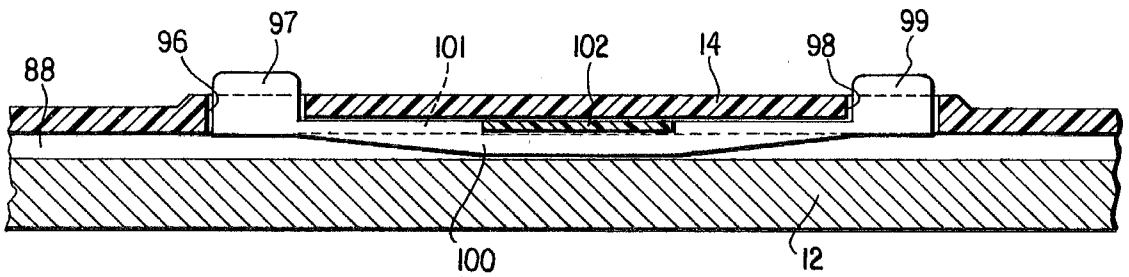
FIG. 20 is a partial cross-sectional view showing the cardholder of FIGS. 18 and 19 in assembled relationship with the print bed of FIG. 12 and the base of FIGS. 9-11.

The upper corners of the card portion of bed 14 are defined by ridges 92 and 94 as shown in FIGS. 12 and 13. These ridges together with openings 96 and 98 define the boundaries of the card holding portion. Referring to FIGS. 18 and 19, a card holder 100 having projections 97 and 99 is shown. Holder 100 is disposed within slot 88 of base 12 and a slot 101 in bed 14, see FIGS. 14 and 20. The holder 100 has a lateral portion 102 which is disposed within a recess 104 shown in FIG. 16.

Figure 17:
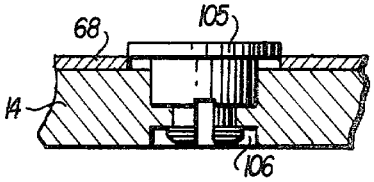

Holes generally indicated at 106 extend through bed 14, the details of these holes being shown in FIG. 17. Disposed within each of the holes 106 is a mounting member 105 upon which printing plate 68 can be mounted as indicated in FIG. 17.

Figure 15:
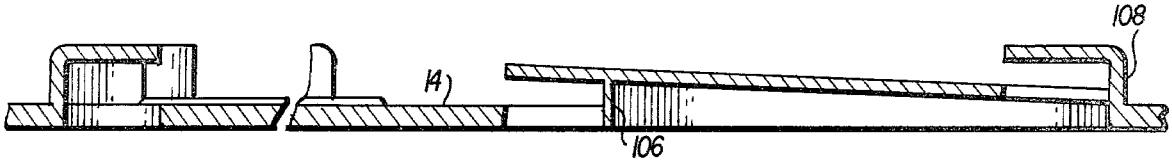
Figure 16:
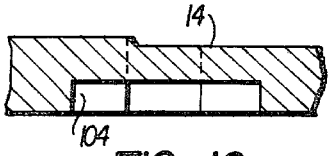

As can be seen in FIGS. 12 and 15, invoice holder 74 is adapted to hold either an invoice of the size of invoice 72 or one of the size of invoice 76 where walls 106 and 108 would respectively be employed for these invoices.

What is claimed is:

1. An imprinter comprising a print bed having a support therefor;

first and second printing members disposed in printing relationship with respect to said print bed, each of said printing members having raised printing indicia thereon;

a document overlying said first and second printing members;

a print roller carriage moveably mounted with respect to said print bed, said carriage having sidewalls respectively disposed adjacent opposite sides of said print bed and a first pair of slots respectively disposed in said sidewalls and slanted in a first angular orientation with respect to said print bed and a second pair of slots respectively disposed in said sidewalls and slanted in a second angular orientation opposite to said first angular orientation of the first pair of slots;

a first shaft, the ends of which are slidingly disposed respectively within said first pair of slots;

a second shaft, the ends of which are slidingly disposed within said second pair of slots;

a first print roller axially mounted on said first shaft so as to co-act only with said first printing member; and a second print roller axially mounted on said second shaft so as to co-act only with said second printing member;

whereby movement of said carriage over said print bed in a first direction causes (a) said first print roller to so co-act with said first printing member and the document portion lying thereover that said first shaft is forced down said first pair of slots to thereby effect imprinting of the indicia on said first printing member onto said document and (b) said second print roller to so co-act with said second printing member and the document portion lying thereover that said second shaft is forced up said second pair of slots so that said second print roller rolls over said last-mentioned document portion without generating sufficient pressure to imprint the indicia from said second printing member onto said document and whereby movement of said carriage in the direction opposite said first direction causes (a) said second print roller to so co-act with said second printing member and the document portion lying thereover that said second shaft is forced down said second pair of slots to thereby effect imprinting of the indicia on said second printing member onto said document and (b) said first print roller to so co-act with said first printing member and the document portion lying thereover that said first shaft is forced up said first pair of slots so that said first print roller rolls over said last-mentioned document portion without generating sufficient pressure to imprint the indicia from said first printing member onto said document.

2. An imprinter as in claim 1 including a third printing member in printing relationship with said print bed and aligned with said first printing member so that both said first and third printing members have their indicia sequentially imprinted onto said document during said movement of said carriage in said first direction.

3. An imprinter comprising a print bed having a support therefor;

first and second printing members disposed in printing relationship with respect to said print bed, each of said printing members having raised printing indicia thereon;

a document overlying said first and second printing members;

a print roller carriage moveably mounted with respect to said print bed, said carriage having sidewalls respectively disposed adjacent opposite sides of said print bed and a first pair of slots respectively disposed in said sidewalls and slanted in a first angular orientation with respect to said print bed and a second pair of slots respectively disposed in said sidewalls and slanted in a second angular orientation opposite to said first angular orientation of the first pair of slots;

a first shaft, the ends of which are slidingly disposed respectively within said first pair of slots;

a second shaft, the ends of which are slidingly disposed within said second pair of slots;

a first print roller axially mounted on said first shaft so as to co-act only with said first printing member; and a second print roller axially mounted on said second shaft so as to co-act only with said second printing member;

whereby movement of said carriage over said print bed in a first direction causes (a) said first print roller to so co-act with said first printing member and the document portion lying thereover that said first shaft is forced down said first pair of slots to thereby effect imprinting of the indicia on said first printing member onto said document and (b) said second print roller to so co-act with said second printing member and the document portion lying thereover that said second shaft is forced up said second pair of slots so that said second print roller rolls over said last-mentioned document portion without generating sufficient pressure to imprint the indicia from said second printing member onto said document and where said second print roller urges said first shaft down said first pair of slots during said movement of said carriage over said print bed in said first direction, said second print roller urging said first shaft down said first pair of slots prior to said first print roller reaching the said raised printing indicia on said first printing member so that said first printing roller is in position to effect imprinting of the indicia on said first printing member when it reaches the indicia thereon and whereby movement of said carriage in the direction opposite said first direction causes (a) said second print roller to so co-act with said second printing member and the document portion lying thereover that said second shaft is forced down said second pair of slots to thereby effect imprinting of the indicia on said second printing member onto said document and (b) said first print roller to so co-act with said first printing member and the document portion lying thereover that said first shaft is forced up said first pair of slots so that said first print roller rolls over said last-mentioned document portion without generating sufficient pressure to imprint the indicia from said first printing member onto said document.

4. An imprinter as in claim 3 where said first print roller urges said second shaft down said second pair of slots during said movement of said carriage over said print bed in said direction opposite said first direction, said first print roller urging said second shaft down said second pair of slots prior to said second print roller reaching the raised indicia on said second printing member.

5. An imprinter comprising a print bed having a support therefor;

first and second printing members disposed in printing relationship with respect to said print bed, each of said printing members having raised printing indicia thereon;

a document overlying said first and second printing members;

a print roller carriage moveably mounted with respect to said print bed, said carriage having sidewalls respectively disposed adjacent opposite sides of said print bed and a first pair of slots respectively disposed in said sidewalls and slanted in a first angular orientation with respect to said print bed and a second pair of slots respectively disposed in said sidewalls and slanted in a second angular orientation opposite to said first angular orientation of the first pair of slots;

a first shaft, the ends of which are slidingly disposed respectively within said first pair of slots;

a second shaft, the ends of which are slidingly disposed within said second pair of slots;

a first print roller axially mounted on said first shaft so as to co-act only with said first printing member; and a second print roller axially mounted on said second shaft so as to co-act only with said second printing member;

whereby movement of said carriage over said print bed in a first direction causes (a) said first print roller to so co-act with said first printing member and the document portion lying thereover that said first shaft is forced down said first pair of slots to thereby effect imprinting of the indicia on said first printing member onto said document and (b) said second print roller to so co-act with said second printing member and the document portion lying thereover that said second shaft is forced up said second pair of slots so that said second print roller rolls over said last-mentioned document portion without generating sufficient pressure to imprint the indicia from said second printing member onto said document and whereby movement of said carriage in the direction opposite said first direction causes (a) said second print roller to so co-act with said second printing member and the document portion lying thereover that said second shaft is forced down said second pair of slots to thereby effect imprinting of the indicia on said second printing member onto said document and (b) said first print roller to so co-act with said first printing member and the document portion lying thereover that said first shaft is forced up said first pair of slots so that said first print roller rolls over said last-mentioned document portion without generating sufficient pressure to imprint the indicia from said first printing member onto said document and where said first pair of slots is disposed with respect to said second pair of slots so that said second print roller moves over said print bed prior to said first print roller during said movement of said carriage in said first direction and said first print roller moves over said print bed prior to said second print roller during said movement of the carriage in said direction opposite the first direction whereby the tendency for vibrations to be introduced into said first print roller by said second print roller during said movement of said carriage in said first direction is lessened and the tendency for vibrations to be introduced into said second print roller by said first print roller during said movement of said carriage in the direction opposite the first direction is also lessened.

6. An imprinter comprising a print bed having a support therefor;

first and second printing members disposed in printing relationship with respect to said print bed, each of said printing members having raised printing indicia thereon;

a document overlying said first and second printing members;

a print roller carriage moveably mounted with respect to said print bed, said carriage having sidewalls respectively disposed adjacent opposite sides of said print bed and a first pair of slots respectively disposed in said sidewalls and slanted in a first angular orientation with respect to said print bed and a second pair of slots respectively disposed in said sidewalls and slanted in a second angular orientation opposite to said first angular orientation of the first pair of slots;

a first shaft, the ends of which are slidingly disposed respectively within said first pair of slots;

a second shaft, the ends of which are slidingly disposed within said second pair of slots;

a first print roller axially mounted on said first shaft so as to co-act only with said first printing member; and a second print roller axially mounted on said second shaft so as to co-act only with said second printing member;

whereby movement of said carriage over said print bed in a first direction causes (a) said first print roller to so co-act with said first printing member and the document portion lying thereover that said first shaft is forced down said first pair of slots to thereby effect imprinting of the indicia on said first printing member onto said document and (b) said second print roller to so co-act with said second printing member and the document portion lying thereover that said second shaft is forced up said second pair of slots so that said second print roller rolls over said last-mentioned document portion without generating sufficient pressure to imprint the indicia from said second printing member onto said document and where the diameter of said second print roller is such that, as said second shaft is forced up said second pair of slots, said second print roller engages said first shaft and urges it down said first pair of slots during said movement of said carriage over said print bed in said first direction, said second print roller urging said first shaft down said first pair of slots prior to said first print roller reaching the said raised printing indicia on said first printing member so that said first printing roller is in position to effect imprinting of the indicia on said first printing member when it reaches the indicia thereon and whereby movement of said carriage in the direction opposite said first direction causes (a) said second print roller to so co-act with said second printing member and the document portion lying thereover that said second shaft is forced down said second pair of slots to thereby effect imprinting of the indicia on said second printing member onto said document and (b) said first print roller to so co-act with said first printing member and the document portion lying thereover that said first shaft is forced up said first pair of slots to that said first print roller rolls over said last-mentioned document portion without generating sufficient pressure to imprint the indicia from said first printing member onto said document.

7. An imprinter comprising a print bed having a support therefor;

first and second printing members disposed in printing relationship with respect to said print bed, each of said printing members having raised printing indicia thereon;

a document overlying said first and second printing members;

a print roller carriage moveably mounted with respect to said print bed, said carriage having sidewalls respectively disposed adjacent opposite sides of said print bed and a first pair of slots respectively disposed in said sidewalls and slanted in a first angular orientation with respect to said print bed and a second pair of slots respectively disposed in said sidewalls and slanted in a second angular orientation opposite to said first angular orientation of the first pair of slots;

a first shaft, the ends of which are slidingly disposed respectively within said first pair of slots;

a second shaft, the ends of which are slidingly disposed within said second pair of slots;

a first print roller axially mounted on said first shaft so as to co-act only with said first printing member; and a second print roller axially mounted on said second shaft so as to co-act only with said second printing member;

whereby movement of said carriage over said print bed in a first direction causes (a) said first print roller to so co-act with said first printing member and the document portion lying thereover that said first shaft is forced down said first pair of slots to thereby effect imprinting of the indicia on said first printing member onto said document and (b) said second print roller to so co-act with said second printing member and the document portion lying thereover that said second shaft is forced up said second pair of slots so that said second print roller rolls over said last-mentioned document portion without generating sufficient pressure to imprint the indicia from said second printing member onto said document and where said second print roller urges said first shaft down said first pair of slots during said movement of said carriage over said print bed in said first direction, said second print roller urging said first shaft down said first pair of slots prior to said first print roller reaching the said raised printing indicia on said first printing member so that said first printing roller is in position to effect imprinting of the indicia on said first printing member when it reaches the indicia thereon and whereby movement of said carriage in the direction opposite said first direction causes (a) said second print roller to so co-act with said second printing member and the document portion lying thereover that said second shaft is forced down said second pair of slots to thereby effect imprinting of the indicia on said second printing member onto said document and (b) said first print roller to so co-act with said first printing member and the document portion lying thereover that said first shaft is forced up said first pair of slots so that said first print roller rolls over said last-mentioned document portion without generating sufficient pressure to imprint the indicia from said first printing member onto said document and where the diameter of said first print roller is such that, as first shaft is forced up said first pair of slots, said first print roller engages said second shaft and urges it down said second pair of slots during said movement of said carriage over said print bed in said direction opposite said first direction, said first print roller urging said second shaft down said second pair of slots prior to said second print roller reaching the raised indicia on said second printing member.

* * * * *